US005125647A

United States Patent [19]

Smith

[11] Patent Number: 5,125,647

[45] Date of Patent: Jun. 30, 1992

[54] JUMP PLATFORM EXERCISER FOR STRENGTHENING THE ANKLE EXTENSORS

[76] Inventor: Robert S. Smith, 1263 Emory St., San Jose, Calif. 95126

[21] Appl. No.: 492,640

[22] Filed: Mar. 13, 1990

[51] Int. Cl.[5] ..... A63B 23/00

[52] U.S. Cl. ..... 482/8; 482/14; 482/51; 482/80

[58] Field of Search ..... 272/64-66, 272/69, 70, 93, 73, 96, DIG. 5, DIG. 6, DIG. 9; 273/1 G, 1 GE, 1.5 R, 1.5 A, 1 GC; 434/247, 248, 255-257; 73/379; 364/561

[56] References Cited

U.S. PATENT DOCUMENTS

| | | | |
|---|---|---|---|
| 3,580,083 | 5/1971 | Zipser | 272/69 X |
| 4,169,588 | 10/1979 | Miffitt et al. | 272/70 |
| 4,199,987 | 4/1980 | Bauers et al. | 73/379 |
| 4,216,956 | 8/1980 | Yamamura et al. | 272/70 |
| 4,285,041 | 8/1981 | Smith | 272/100 X |
| 4,502,680 | 3/1985 | Blum et al. | 272/96 |
| 4,534,552 | 8/1985 | Bigelow et al. | 273/1 GC X |
| 4,736,312 | 4/1988 | Dassler et al. | 364/561 |
| 4,928,959 | 5/1990 | Bassett et al. | 272/70 X |
| 4,932,137 | 6/1990 | Haley et al. | 273/1 GC X |

FOREIGN PATENT DOCUMENTS

| | | | |
|---|---|---|---|
| 0115925 | 9/1979 | Japan | 272/DIG. 9 |
| 0117232 | 9/1979 | Japan | 272/DIG. 9 |
| 0159029 | 12/1979 | Japan | 272/DIG. 9 |

OTHER PUBLICATIONS

CMOS Cookbook by Don Lancaster, publish by SAMS and Co., Indianapolis, Ind. 1980, pp.-237, 308, 74, 250, 221, 46, 217.

*Primary Examiner*—Richard J. Apley
*Assistant Examiner*—Glenn E. Richman
*Attorney, Agent, or Firm*—Robert Samuel Smith

[57] ABSTRACT

An exercise apparatus for strengthening the ankle extensors which includes a platform on which a user jumps repetitively while monitoring the time that he is in contact with the platform and the time that he is out of contact with the platform. In one embodiment, the platform is hinged to a base platform along an edge with a spring and switch in between. The spring holds the platform and base panel slightly apart except when the user is standing on the platform. The switch has two sets of poles, one of which sets activates a circuit for timing the time in contact and the second of which sets activates the time of flight of each jump when the user is out of contact. Monitoring of each period can be performed by any one of several circuits. One circuit includes a clock and display for displaying the current flight or contact time. Another circuit includes structure for presetting target periods for flight and contact times. A respective signal is emitted if actual contact time or flight time exceeds target times respectively. Yet another embodiment measures the total in-contact time for a given number of jumps and the flight time is monitored by controlling jump height to a given value by looking in a mirror as the user jumps.

4 Claims, 1 Drawing Sheet

FIG. 1
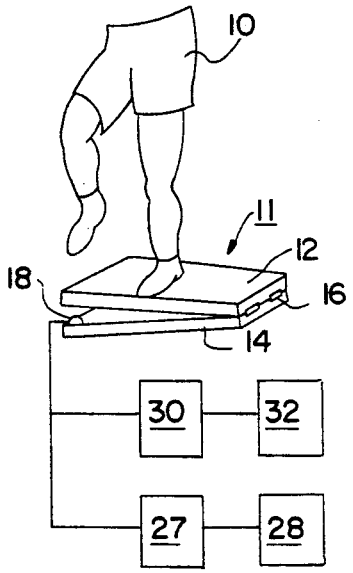
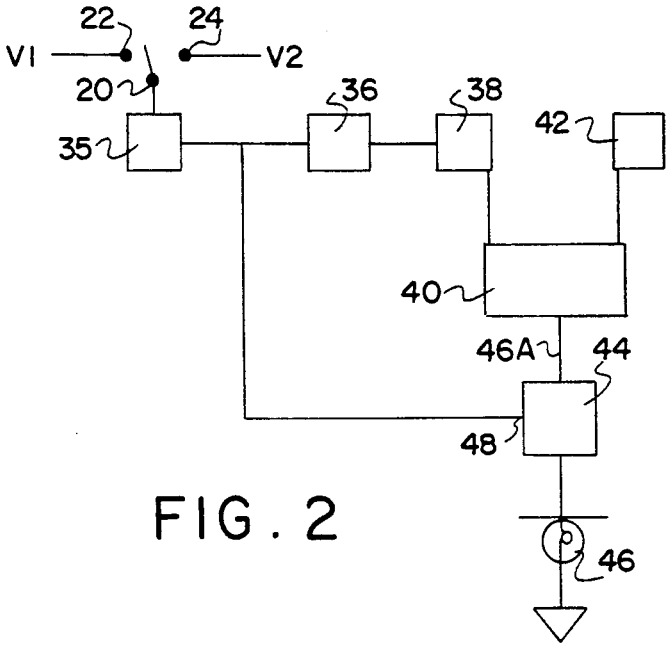
FIG. 2
FIG. 3
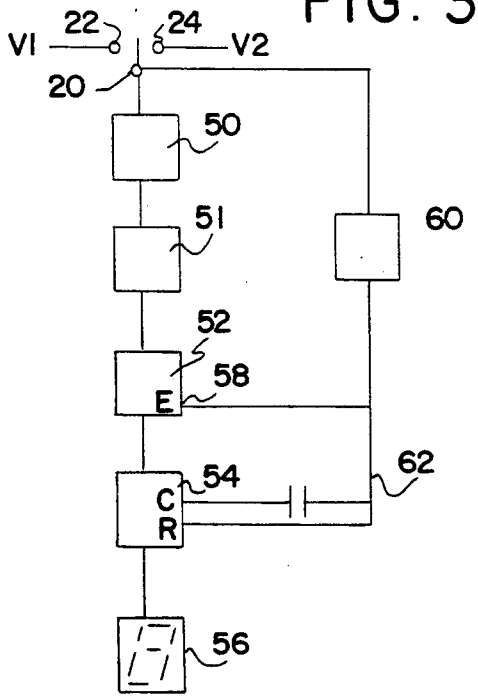
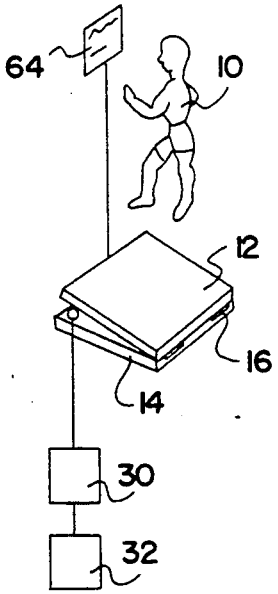
FIG. 4

JUMP PLATFORM EXERCISER FOR STRENGTHENING THE ANKLE EXTENSORS

FIELD OF THE INVENTION

This invention relates to apparatus used for performing exercises and particularly to an apparatus for improving sprinting and leaping ability of the user.

BACKGROUND AND INFORMATION DISCLOSURE STATEMENT

The ability to run fast is an important asset in most all sports. Therefore, athletes and their coaches have developed various exercises and apparatus that are intended to improve this ability.

There are numerous characteristic of sprinting that determine one's ability to sprint fast. The act of sprinting involves the runner swinging his legs to perform a scissors motion which is accomplished by vaulting himself off the ground alternately using each foot. Characteristics that are obvious to the observer in determining speed of running are frequency of stride and stride length. Properties of the musculature that are relied upon to attain large frequency and stride length are strength and quick neurological reflexes in the hip flexors and extensors. Consequently, considerable emphasis has been placed on developing apparatus and exercise designed to strengthen and quicken the hip flexors and extensors.

For example, U.S. Pat. No. 4,456,248 to R. S. Smith is for a rack type of apparatus on which the athlete can perform situps and back extensions.

Another exercise is performed with a rope and pulley arrangement wherein one end of the rope is attached to the athlete, the rope passes through a pulley attached to his partner and the other end is fixed. The partner is positioned ahead of and attempts to run away from the athlete. Because of the pulley, the athlete must run twice as fast as the partner. Consequently, he becomes accustomed to running at top speed and thereby develops his neurological responses.

U.S. Pat. No. 4,728,100 to R. S. Smith is for a device incorporating a photocell in which the user interrups a light beam to time his repetitions in order to increase frequency of his movements.

Exercises intended to improve the runner's ability to vault himself off the ground involve the athlete's jumping off a platform and landing on his feet (referred to as "pliometrics"). The shock of the landing has been found to strengthen the muscles (ankle and knee extensors) involved in jumping.

Less attention has been directed toward the runners ability to vault himself off the ground. The lack of attention to this characteristic is undoubtedly due to the fact that a top sprinter vaults himself vertically only about two inches off the ground with each stride so that this characteristic does not appear to be important to the casual observer. However, calculations performed by the author show that the grounded foot must exert a force on the ground of about six times the body weight for about 30 milliseconds in order to vault the athlete two inches into the air when his stride frequency is about five strides per second. The weaker the athlete from the standpoint of the vertical force that he can exert, then the longer will be the time required to exert the force (referred to hereinafter as contact time.). Therefore, even though he may have superior hip flexors and extensors, his excessive contact time would reduce his stride frequency and thereby prevent him from making full use of his potential hip flexing ability.

In order to reduce the time of foot contact and correspondingly increase the athlete's applied vertical force during foot contact, the exertion must come from the ankle extensors rather than the knee extensors. In other words, the knee should not "sag".

In the following description of the invention, embodiments are presented which include novel combinations of circuits that have been described in the prior art. These descriptions may be found in application notes published by manufacturers of integrated circuit components. In particular, the following circuits are described in a book entitled "CMOS COOKBOOK" by Don Lancaster published by Howard W. Sams and Co., 4300 62nd St. Indianapolis, Ind. 46268. The table includes the component title, its manufacturer identification number and the page in the CMOS COOKBOOK where the component is discussed and has particular relevance to the embodiments of this invention:

| | | |
|---|---|---|
| 4001 | Crystal Oscillator | page 237 |
| 4026 | Single Package per Decade Counting System | page 308 |
| 4013 | Dual D Flip Flop | page 74 |
| 4528 | Monostable Multivibrator | page 250 |
| 4050 | Debounce Switch | page 221 |
| NPN transistor | Darligton Transistor Drive | page 46 |
| 4001 | Hold Follow Latch | page 217 |

An additional reference is U.S. Pat. No. 4,745,259 to Russ et al which describes the setting of thumbwheel switches in conjunction with counter chips LS240 to establish a predetermined count representing a desired length of weld to be compared to a measured count representing an actual length of weld using comparator IC's LS682.

THE INVENTION

Objects

It is an object of this invention to provide an apparatus and method for developing the hip, knee and, primarily, the ankle extensors of an athlete in order to improve his vertical leaping ability.

It is another object that his vertical leaping ability be enhanced in order to improve his sprinting skill.

Other objects will occur to the reader after studying the drawings and preferred embodiments.

Summary

This invention is directed toward a platform upon which a user jumps up and down during which he monitors the time that he is in contact with the platform and the time that he is out of contact with the platform with each jump.

The improvement of the users sprinting ability as a result of practicing the exercises provided by this invention results from the user being able to control the intensity of his exertion by constantly monitoring his performance. A top sprinter need only vault himself two inches off the ground during each stride. However he must generate enough vertical impulse to do this with a period of foot contact equal to less than thirty milliseconds. By performing and monitoring the exercises available from the methods and apparatus of this invention, the user is able to improve his jumping ability toward this objective.

The user jumps up and down while watching two signals. One signal indicates to the user the length of time, t', that the user is in contact with the platform and a second signal indicates the length of time, t'', that the user is out of contact with the platform. The user is guided by the signals in attempting to shorten t' for a given value of t''.

The measurements, t' and t'', indicate how much force, F, the user exerts when his foot is in contact with the platform in accordance with the relation—

$$Ft'=Mgt''$$

where g is the gravitational constant and M is the mass of the user.

According to one embodiment, the user watches two lights when he jumps. A first light comes "on" momentarily when t'' exceeds a preset value, T''. A second light comes "on" when t' exceeds a preset value T'. The user trains himself to adjust the height of his jump, H, to keep the T'' light on and the length of time he is in contact with the floor to keep the T' light off.

T'' is related to H according to—

$$H=gT''/8$$

Ideally, the user's goal is to train himself to where H is approximately two inches and T' is about 30 milliseconds if his objective is to run 100 yds. between 9 and 10 seconds.

An apparatus to implement the foregoing embodiment includes a platform hinged along one edge to an underlying panel. A switch between the platform and panel changes position when the user moves into and out of contact with the platform. The switch has two sets of poles. Each set has a common terminal, a normally open terminal and a normally closed terminal. One set of poles activates a first circuit that monitors contact time t' and the second set activates a second circuit that monitors flight time t''.

According to one embodiment of a timing-signal circuit, each circuit includes an adjustable timer that can be preset by the user to target periods T'' or T'. When the user performs the jumping exercise, a signal light comes on when the actual flight time t'' exceeds T'' and a second signal light comes on if t' exceeds T'.

According to a second embodiment, during the time that the user is in contact with the platform, a switch between the platform and panel is closed. Appropriate circuitry is used to display contact time of each jump as indicia in one display and out of flight time of each jump can be displayed as indicia on a second display.

An alternative method to measuring the flight time of each jump is to perform a number of jumps on a platform in which a clock is connected to run and display the total time that the user is in contact with the platform. The average time of contact for each jump equals the quotient of total contact time divided by the number of jumps.

Another method of monitoring flight time is to measure the height that the user jumps. This is accomplished by positioning a mirror with indicia on its surface so that when he jumps, he can note his jump height by watching his image in the mirror. The value of monitoring is proven by the well known phenomenon presented by biofeedback.

The great value to applying the use of this exercise toward the improvement of sprinting ability resides in the principle of ISOLATION. If an athlete attempts to reduce his contact time simply by sprinting, his entire body and pricipally his cardiovascular system will be exhausted long before his ankle extensors have been completely exhausted. However, in the performance of exercises in accordance with this invention, major exertion is focussed on the ankle extensors guaranteeing with undiminished support from the cardiovascular system.

Drawings

FIG. 1 shows a user jumping on the platform of this invention.

FIG. 2 shows a circuit involving the use of signal lights to monitor flight and contact times.

FIG. 3 shows a circuit with an indicia display to monitor flight and contact times.

FIG. 4 illustrates the use of a mirror to monitor time in flight. and a clock to monitor time in contact.

DETAILED DESCRIPTION OF THE BEST MODES

The following detailed description illustrates the invention by way of example and not by way of limitation of the principles of the invention. This description will clearly enable one skilled in the art to make and use the invention and describes several embodiments, adaptations, variations, alternatives and uses of the invention, including what I presently believe is the best mode for carrying out the invention.

Turning now to a discussion of the drawings, there is shown in FIG. 1 a user 10 on the platform apparatus 11 of this invention. The user jumps up and down on the platform so that he is alternately in contact with the platform for a period t'' and in flight for another period t'. The apparatus is shown to include a platform 12, hinged along one edge to a support panel 14 by hinges 16. A switch 18 is interposed between the platform 12 and panel 14. A spring (not shown) is also between the platform and panel so that the switch is in a "contact" position when the user is in contact with the platform and in a "flight" position when the user is in flight out of contact with the board. The switch 18 is double throw and in contact position monitors "contact" time t'' and in the flight position monitors "flight" time t'.

When the switch is in a "flight" position corresponding to when the user is out of contact with the platform, a "flight" timing circuit 30 is activated to measure t' which is presented to the user by "flight" signalling means, 32.

When the switch is in the "contact" position which occurs when the user is on the platform, a "contact" timing circuit 27 is activated to measure t'' which is presented to the user by "contact" signalling means 28.

Any one of a number of timing circuits and signalling means can be used to implement the operation embodied in FIG. 1 and all are various embodiments of the invention.

One means for signalling the user is by means of a flight light that is energized when the time of flight t' exceeds a preset value T' and a contact light that is energized when the time in contact t'' exceeds a second preset value T''. In this embodiment, switch 18 is double pole double throw in which one set of poles activates the circuit monitoring t' and the second set of poles activates the circuit monitoring t''.

A circuit for performing this operation is illustrated in the schematic circuit diagram of FIG. 2. This circuit will be discussed in terms of its use in monitoring flight time t' however it will be understood that an identical circuit with another signal light may be used to simultaneously monitor contact time t''.

FIG. 2 shows one half of the double pole double throw switch 18 which operates through a debounce circuit 35 to start a clock 36 when common terminal 20 is closed to terminal 22. Terminal 22 is at a first potential V1 (ground for clock IC). Pulses from the clock 36 may be divided by an appropriate value, n, which are counted by a pulse counter 38. The pulse count is fed to a comparator 40 where it is compared to a constant signal from a switch array 42. The signal from switch array 42 is preset by, e.g., thumbwheel switches to represent the corresponding preset time, T'. T' is the target period wherein the user strives to maintain t' less than T'.

If the common 20 of switch 18 closes to position 24 (which is held at a second electrical potentioal V2) before the flight time t' (pulse count) from 38 equals preset time T', output from the clock 36 is interrupted, the pulse counter 38 is reset and the clock is dormant until the common terminal 20 of switch 18 returns to position 22 initiating a new flight time period t'.

If the flight time, t' is longer than the preset time period T', then an output on comparator 40 will set a latch 44. Latch 44 is a D-type Flip-Flop having a data input terminal 46*a* connected to the output terminal of the comparator 40 and a control terminal 48 which is enabled by the leading edge of a pulse generated when the start switch 18 changes from the "flight" position to the "contact" position. This change of switch position also initiates a resetting of the pulse counter to zero to await the next leap by the user but the latch 44 holds the signal light 46 "on" until the end of the succeeding flight period.

To perform the exercise, the user first sets each set of thumbwheel switches to correspond to the periods of T' and T'' which are his target periods for t' and t'' in performing the exercise. Then he jumps repetitively on the platform on one foot or alternately on each foot and controls times t' and t'' so as to keep both signal lights out.

Another signalling means is illustrated in FIG. 3. in which the current values of t' and t'' are displayed to the user as he is performing his exercise. There is shown the switch 18, and clock 50 and clock pulse counter 51 (or divider) which operate similarly to the embodiment of FIG. 2. A free running clock 50 is shown which applies pulses to a decade counter 52 with seven segment decoded output. The seven segment output is stored in a latch array 54 which activates a numerical display 56. After the seven segment output is stored in the latch, the counter is reset to zero by a pulse on the reset terminal 58 coming from switch 18 and conditioned by Schmitt trigger 60.

The Schmitt trigger 60 emits a square pulse having a leading and trailing edge in response to common terminal 20 moving to V2 at the end of the count period. The Schmitt trigger thereby conditions the pulse from terminal 20 for application to the enable and reset lines of the counter and the clock line of the latch 54. The "enable" terminal responds to the leading edge of the pulse from the Schmitt trigger and goes high to cause counter 52 to discontinue counting and hold the count while the count is transferred to the latch 54. This transfer takes place because the clock terminal 62 of the latch 54 also responds to the leading edge of the pulse from the Schmitt trigger 60. After the transfer to the latch takes place, the counter 52 is reset to zero by connection of the reset terminal 58 to the Schmitt trigger 60. The reset responds to the trailing edge of the trigger pulse.

The apparatus in this embodiment comprises two circuits, each identical to FIG. 3, and corresponding to circuits 30 and 27 in FIG. 1. One circuit is activated by one set of poles of double pole double throw switch 18 to display the current value of t' and the other circuit is activated by the second set of poles to display the current value of t''.

Another embodiment of this invention is illustrated in FIG. 4. The apparatus includes one timing circuit 30 which monitors contact time t' and a mirror 64. The mirror 64 is positioned so that the user can just see the top of his head when he jumps so that he can control the height of his jump which corresponds to his time in flight t''.

Other constructions of the platform apparatus for jumping are embodiments of this invention. For example, a load cell may be interposed between the platform and base panel in place of the switch. In another arrangement, the user may jump on the top surface of a pressurized enclosure with appropriate circuitry to sense in and out of contact times.

Yet another method of monitoring contact time is to have switch 18 activate a clock when the switch is in the "contact" position for a known number of jumps. The average contact time equals the total measured contact time divided by the total number of jumps. Of course this method does not provide the instantaneous feedback information provided by the other methods of measurement.

In the foregoing paragraphs, a number of embodiments have been described which acheive the objects of the invention—the main object being to strengthen the ankle and knee extensors by performing a jumping exercise while monitoring the force that is exerted by the foot on a jumping platform and the time that the foot is in contact with the platform. Electrical apparatus have been described to provide measurements which may be interpreted in terms of force and contact time. Ability to increase force and reduce contact time results in increased sprinting speed.

It should be understood that various modifications within the scope of this invention can be made by one having ordinary skill in the art without departing from the spirit thereof. I therefore wish my invention to be defined by the scope of the appended claims and in view of the appended claims if need be.

I claim:

1. An apparatus with which a user may perform jumping exercises which comprises:

a platform means on which a user may stand and perform a succession of jumps in which, during each jump, the user is in contact with the platform means for a period of contact time and in flight for a period of flight time;

a first means in operable combination with said platform means for monitoring said contact time of said jumps;

a second means in operable combination with said platform means to monitor said flight time of said jumps; and wherein said first and second monitoring means each comprise:

a clock having an output terminal means and that emits clock pulses on said clock output terminal means;

a means for counting pulses having an output terminal means and a first input terminal means connected to said clock output terminal means and a second input terminal means connected to said common terminal of said monitoring means thereby providing that a signal representing a number of pulses emitted from said clock corresponding to a timing period when said common terminal is at said first potential will be presented at said output terminal means of said counter;

a means for presetting a signal corresponding to an arbitrary target period;

a means for comparing signals having an input terminal means connected to said setting means and another input terminal means connected to said ouput terminal means of said counting means thereby providing that a comparator signal will be emitted from an output terminal means of said comparing means when said timing period exceeds said target period;

a means for latching said comparator signal for a recognition period connected to said output terminal of said comparator;

a means for signalling connected to said latch thereby emitting a signal to said user while said latch holds said comparator signal.

2. An apparatus as in claim 1 wherein said signaling means is a light.

3. An apparatus with which a user may perform jumping exercises which comprises:

a platform means on which a user may stand and perform a succession of jumps in which, during each jump, the user is in contact with said platform means for a period of contact time and in flight for a period of flight time;

a first means in operable combination with said platform means for monitoring said contact time of said jumps including a contact switch having a common contact terminal that is connected to a first potential when said user is in contact with said platform means and to a second potential when said user is in flight from said platform, a clock having an output terminal means that emits clock pulses on said clock output terminal, a means for counting pulses having one input terminal means connected to said output clock terminal and another input terminal means connected to said common terminal and a counter output terminal, a decade counter having an input terminal means connected to said counter output terminal and an output terminal, a means for latching an input signal for a recognition period having an input terminal connected to said output terminal of said decade counter and an output latch terminal means, a means for decoding and segment displaying a decade count signal having an input terminal means connected to said latch output terminal means, thereby providing said contact period will be presented by said display means for a recognition period;

a second means in operable combination with said platform means for monitoring said flight time of said jumps including a flight switch having a common flight terminal connected to said second potential when said user is in contact with said platform and connected to said first potential when said user is in flight from said platform means, a clock having an output terminal on which are emitted clock pulses, a means for counting pulses having one input terminal means connected to said output clock terminal and another input terminal means connected to said common flight terminal, a decade counter having an input terminal means connected to said counter output terminal and an output terminal, a means for latching an input signal for a recognition period having an input terminal connected to said output terminal of said decade counter and an output latch terminal means, a means for decoding and displaying a decade count signal having an input terminal means connected to said output latch terminal, thereby providing that said flight period will be presented by said display means for a recognition period.

4. An apparatus with which a user may perform jumping exercises which comprises:

a platform means on which a user may stand and perform a succession of jumps in which, during each jump, the user is in contact with the platform means for a period of contact time and in flight for a period of flight time;

a contact clock;

a first means for switching in operable combination with said platform means and said contact clock to turn on said clock when said user is in contact with said platform thereby providing that said clock will display said contact time;

a flight clock;

a second means for switching in operable combination with said platform means and said flight clock to turn on said flight clock when said user is in flight from said platform means thereby providing that said clock will display said flight time.

* * * * *